United States Patent [19]

Abrams

[11] Patent Number: 4,974,355

[45] Date of Patent: Dec. 4, 1990

[54] HANGER SIGN

[76] Inventor: Carroll Abrams, 6917 W. 79th, Apt. 211, Overland Park, Kans. 66201

[21] Appl. No.: 345,456

[22] Filed: May 1, 1989

[51] Int. Cl.[5] ..... G09F 3/00

[52] U.S. Cl. ..... 40/591; 40/667

[58] Field of Search ..... 40/591, 593, 667, 662, 40/643, 644; D20/10, 19, 42, 43; D12/187, 188; 248/690, 691, 692, 301

[56] References Cited

U.S. PATENT DOCUMENTS

| | | | |
|---|---|---|---|
| 1,196,332 | 8/1916 | Cabell, Jr. . | |
| 1,272,394 | 7/1918 | Devney . | |
| 1,276,735 | 8/1918 | Devney . | |
| 1,446,841 | 2/1923 | Dietsche, Jr. . | |
| 2,032,102 | 12/1935 | Sauer | 40/667 |
| 2,099,029 | 11/1937 | McKay . | |
| 3,255,543 | 6/1966 | Plazibat | 40/591 |
| 3,704,037 | 11/1972 | Glassberg | 40/591 X |

FOREIGN PATENT DOCUMENTS

| | | | |
|---|---|---|---|
| 601151 | 8/1934 | Fed. Rep. of Germany | 40/662 |
| 812303 | 8/1951 | Fed. Rep. of Germany | 40/662 |
| 3246600 | 6/1984 | Fed. Rep. of Germany | 40/591 |
| 878954 | 2/1943 | France | 40/662 |

*Primary Examiner*—James R. Brittain

*Attorney, Agent, or Firm*—Litman, McMahon & Brown

[57] ABSTRACT

A sign made of relatively heavy paper, cardboard, plastic or the like is adapted for convenient mounting on the interior rear view mirror support of automotive vehicles. The sign is positioned between the mirror and the rear surface of the front windshield and includes an integral hook which is bent rearwardly out of the plane of the sign to engage a mirror support of the type which projects roughly parallel to the windshield. For the type of mirror support which is adhesively connected to the rear surface of the windshield and projects roughly rearwardly thereof, the hook is bent rearwardly and downwardly, exposing a hook-shaped opening through which the mirror support is extended. Access into the opening is permitted by means of a slit extending from the opening to the peripheral edge of the hanger sign. A bending score is directed horizontally across the sign for use in bending the sign, if desired, when minimal clearance is provided between the rear surface of the windshield and the back of the mirror.

7 Claims, 2 Drawing Sheets

HANGER SIGN

BACKGROUND OF THE INVENTION

The present invention relates to a sign adapted to be hung from the structure which supports the rear view mirror in an automotive vehicle. The sign is intended, but not restricted, to a location between the back surface of a vehicle rear view mirror and the rear surface of the vehicle windshield, where it can be easily viewed from the front area of the vehicle but will not significantly obstruct the view of the driver or passengers within the vehicle.

It is known to hang a printed card on the rear view mirror support of a vehicle through use of an opening punched through the card and having a slit extending from periphery of the card to the opening, whereby the support may be directed along the slit into the opening. This is common practice, for example, in automobile repair establishments or parking lots to provide identification. Such cards often hang freely and swing with vehicle motion. They further often hang substantially below the lower edge of the mirror, partially blocking the view from within the vehicle.

Also, when an attempt is made to hang such cards on a vehicle having a rear view mirror of the type where the mirror support extends roughly parallel to the rear surface of the windshield, as for example in the case of a roof-supported arm, it is difficult to attach the card. Occasionally, in frustration, the card will be placed so that it hangs over the reflective face of the mirror, rather than between the back of the mirror and the rear surface of the windshield. This renders the mirror at least partially non-functional and may create a dangerous situation.

This invention offers a substantial improvement in hanger signs, allowing them to be used conveniently and safely, not only for identification, but for clear display of advertising messages and "bumper sticker" type slogans.

OBJECTS OF THE INVENTION

The principal objects of the present invention are: to provide a hanger sign which is conveniently mountable on the rear view mirror support of a vehicle, regardless of whether it extends generally downwardly or rearwardly from its anchor point; to provide such a hanger sign which utilizes an integral hook cut from the body of the sign; to provide such a sign which includes a slit extending from the periphery thereof to a hook-shaped opening created by bending the integral hook out of the sign plane; to provide such a hanger sign arrangement which allows the sign to be selectively suspended by the integral hook or by entering the mirror support into the hook-shaped opening which remains upon bending the hook out of the sign plane; to provide such a hanger sign arrangement where the peripheral shape of the sign roughly matches the size and shape of the mirror body elevation, whereby the sign offers little, if any, viewing obstruction over that created by the mirror itself; to provide such a hanger sign having a bending score extending horizontally thereacross upon which to conveniently bend the sign to better conform to the space provided between the rear surface of the windshield and the mirror and mounting structure therefor; to provide such an arrangement which is particularly well adapted for displaying an advertising message, slogan or identification data to an area around the front of an automotive vehicle; and to provide such an object which is easily and inexpensively manufactured, mounted, removed and otherwise well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may take various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
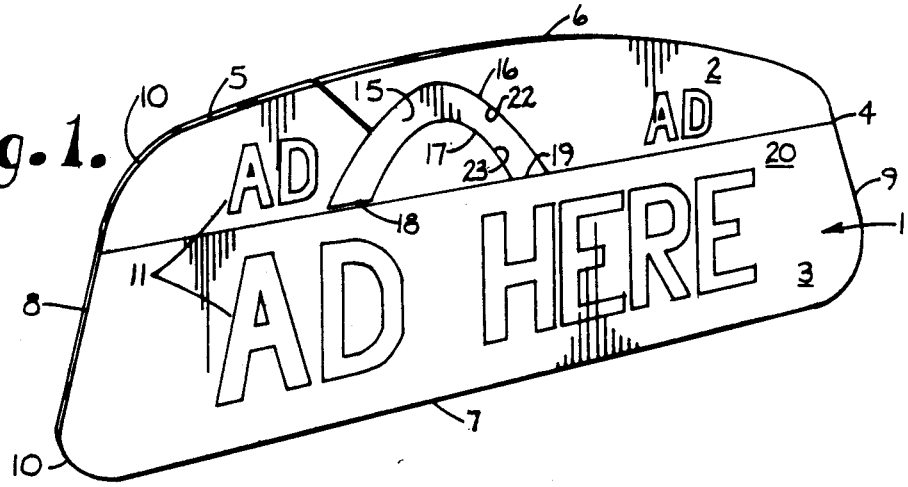
FIG. 1 is a perspective view showing a hanger sign constructed in accordance with this invention.
Figure 2:
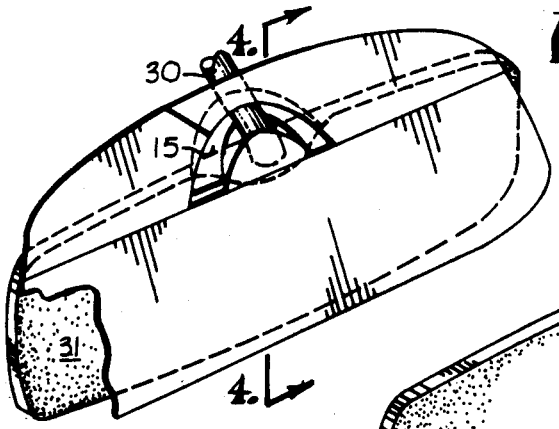
FIG. 2 is a perspective view showing the sign supported on the back side of a rear view mirror by means of an integral hook bent out of the plane of the sign.

The reference numeral 1 generally designates a hanger sign embodying this invention. The sign may be conveniently constructed of heavy paper, cardboard, or various types of semi-rigid plastic and comprises an upper section or face 2, FIG. 1, and a lower section or face 3 separated from each other by a horizontal bending score 4. The peripheral edge 5 of the hanger sign is roughly shaped in the form of an elongated, horizontally extending rectangle having an upper edge 6, a lower edge 7, and side or lateral edges 8 and 9 all joined together by relatively generous corner edges 10. The peripheral shape of the hanger sign 1 between the bending score 4 and lower edge 7 generally approximates the elevational profile of many common automobile rear view mirrors. The upper face 2 extends above the lower face 3, whereby the faces 2 and 3 together form a substantial area for printing words, pictures or data 11 which may take the form of an advertisement, slogan, identification or graphics.

Figure 6:
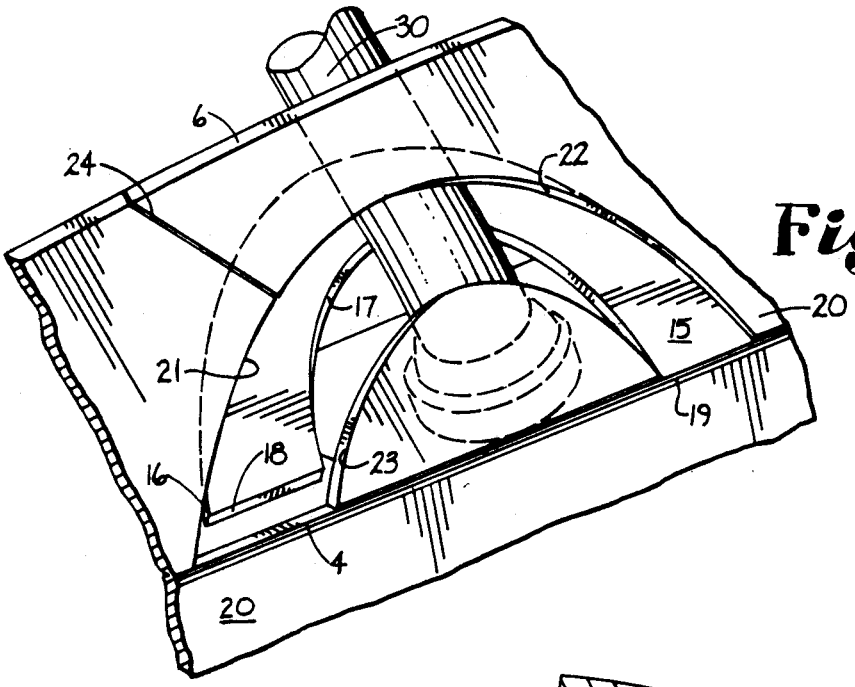
FIG. 6 is an enlarged fragmentary perspective view detailing the use of the hook when mounting the sign as in FIG. 2.

A cut extends through the sign 1 in a hook shape forming a hook 15 which has a curved upper periphery 16, a curved lower periphery 17, a free end 18, and a hinged end 19 which remains integral with the body 20 of the sign. The hook 15 may be easily bent along the hinged end 19 out of the plane of the body 20 as shown in FIG. 6. When said hook 15 is so bent, an opening 21 is formed having the shape of the hook 15 but with an upper peripheral edge 22 and a lower peripheral edge 23. A slit 24 extends through the sign from the upper edge 22 to the upper edge 6 of the upper face 2, providing easy access into the opening 21 from the exterior edge of the sign 1.

Figure 7:
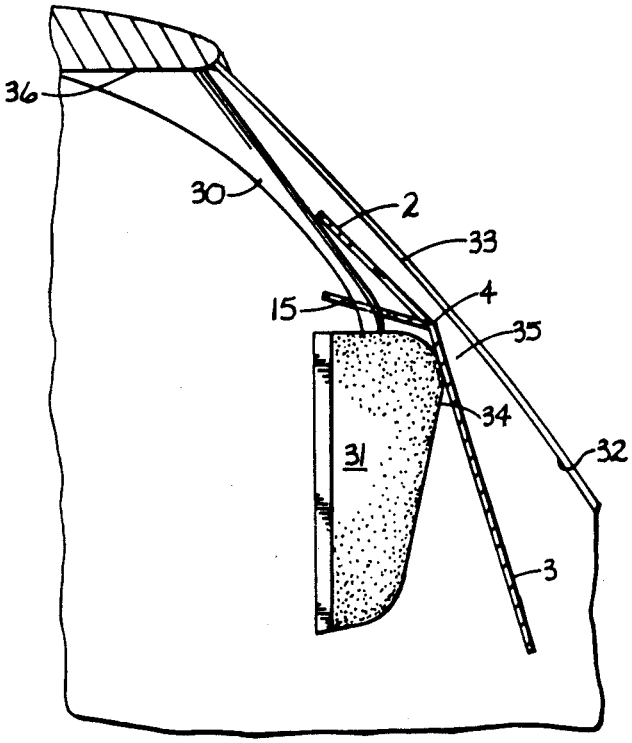
FIG. 7 is a view similar to FIG. 4 but showing the sign mounted where there is little space provided between the mirror and rear surface of the windshield and the sign has been bent along a bending score to better conform to the space available.

In use, the integral hook 15 is bent rearwardly out of the plane of the body 20 and hooked about an arm 30, FIGS. 2, 4, 6, 7 supporting a rear view mirror 31 near rear surface 32 of a windshield 33. As shown in FIG. 7, the rear view mirror 31 may extend quite close to the rear surface 34 of the rear view mirror 31, leaving only a narrow space 35 therebetween.

The arm 30 is of a common type anchored above the rear view mirror 31 at a roof portion 36, FIG. 7, whereby the arm 30 extends generally downwardly roughly parallel to the rear windshield surface 32. Under these circumstances, for best display, it may be desirable to bend the upper face 2 rearwardly with respect to the lower face 3 along the bending score 4 so that, in side elevation, the hanger sign roughly follows the contour of the windshield and arm 30 without contacting the windshield and while resting fairly securely upon the rear surface 34 of the rear view mirror 31. This places the integral hook 15 in a tensile retaining position and results in minimal tendency to swing.

Figure 4:
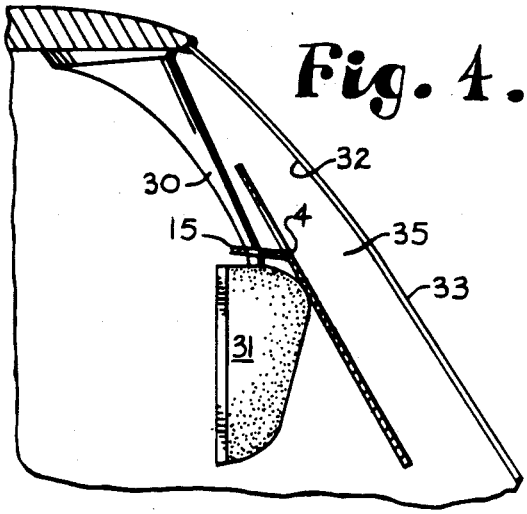
FIG. 4 is a fragmentary cross-sectional elevation taken on the lines 4—4, FIG. 2, showing the sign mounted by means of the integral hook.

If the vehicle is of the type permitting ample space 35', FIG. 4, between the rear of the rear view mirror and the inner surface of the windshield, the sign may be easily hung and displayed through the windshield at a desired angle without bending along the score 4.

Figure 3:
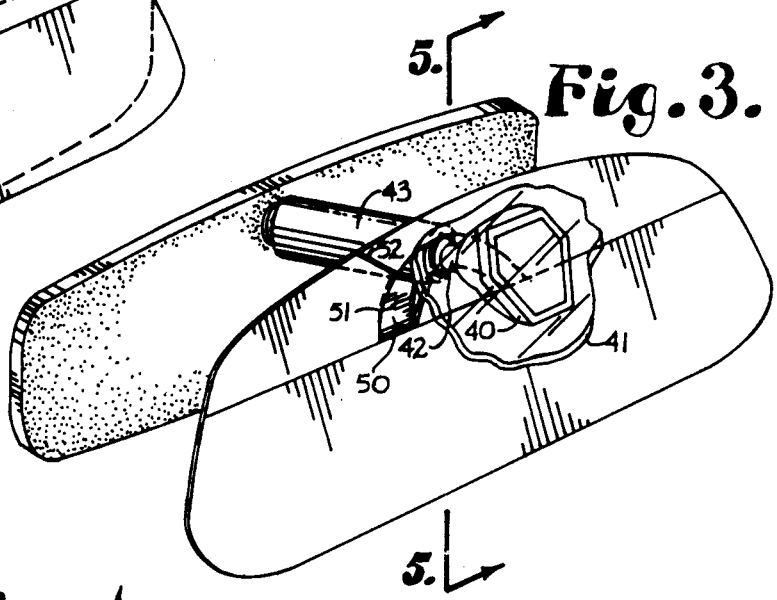
FIG. 3 is a perspective view showing the sign mounted through the hook-shaped opening remaining when the hook is bent out of the plane of the hanger sign.
Figure 5:
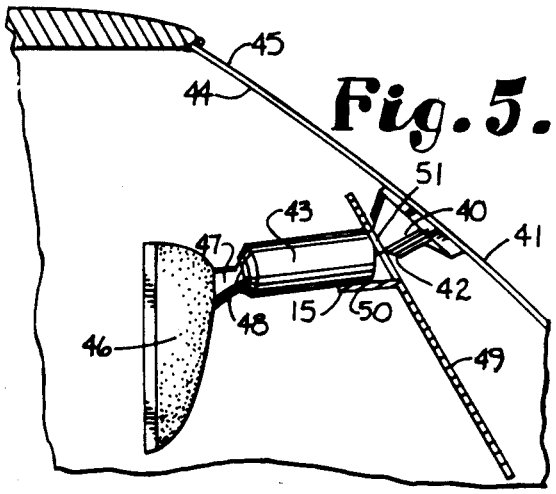
FIG. 5 is a view similar to FIG. 4 but taken on the lines 5—5, FIG. 3, showing the sign mounted through the hook-shaped opening.

An alternate arrangement for mounting rear view mirrors, often found in modern automobiles, is illustrated in FIGS. 3 and 5. In this instance, a base mounting structure 40 is adhesively secured or otherwise anchored to the windshield 41 and has a stub 42 forming a swivel joint with an extension arm 43. The arm 43 is directed generally horizontally rearwardly from the interior surface 44 of the windshield. A rear view mirror 46 has secured thereto a stub 47 at the rear surface thereof, which forms a swivel joint with the extension arm 43 at 48.

A convenient and efficient arrangement for hanging a hanger sign 49, in the arrangement of FIG. 5, is bending the integral hook 50 rearwardly of the sign 49 and downwardly, thereby forming a hook opening 51 and utilizing a slit 52, as described above, to gain entrance into the opening 51 for the stub 42. The trapping of the stub 42 in the opening 51 combined with resilient pressure of the hook 50 against the extension arm 43 causes the sign 49 to rest roughly parallel to the angle of the windshield, thereby efficiently displaying matter printed thereon from the front portion of the automobile with a minimal tendency to swing.

Although the above noted invention has been particularly described for use with rear view mirrors, it is to be understood that it may be used in other locations and for other purposes where the provision of alternate structural arrangements for hanging would be advantageous.

It is to be further understood that while certain forms of the present invention have been illustrated and described herein, it is not to be limited to the specific forms or arrangement of parts described and shown, except insofar as such limitations are included in the following claims.

What is claimed and desired to be secured by Letters Patent is as follows:

1. A hangar sign comprising a planar body of semi-rigid sheet material;

(a) a planar curve member formed substantially entirely within said body with surrounding margins of said sheet material extending substantially entirely around said curved member and adapted to be bent out of the plane thereof;

(b) said curved member having one end free and another end integral with said body with a hooked portion defining a concave edge connecting the two ends;

(c) whereby said member takes the form of a hook for supporting said sign.

2. A hanger sign comprising:

(a) a planar body of semi-rigid sheet material;

(b) a planar hook formed substantially entirely within said body with a surrounding margin of said sheet material extending substantially entirely around said hook and having one free end and one fixed end connected with said body with a hooked portion defining a concave edge connecting the two ends;

(c) the connection with said body forming a hinge area for bending said hook out of the plane of said body.

3. The hanger sign as set forth in claim 2 wherein:

(a) a slit extends from the periphery of said body through said margin to said hook.

4. The hanger sign as set forth in claim 2 wherein:

(a) said sign has a peripheral profile roughly conforming to the peripheral outline of an automobile rear view mirror.

5. The hanger sign as set forth in claim 2 wherein:

(a) said sign has a horizontal bending score extending thereacross and dividing said sign into an upper face and a lower face; and (b) said hook is cut substantially from said upper face.

6. A hanger sign for display at the rear surface of an automotive rear view mirror having a support arm, said sign comprising:

(a) a planar body of semi-rigid sheet material;

(b) a planar hook cut from said body, said hook being substantially entirely within the periphery of said body with a margin of said sheet material surrounding said hook, said hook having one end free and one end integral with said body; and (c) a slit extending from the periphery of said body through said margin to said hook;

(d) whereby said body may be hung selectively upon either downwardly extending or rearwardly extending rear view mirror support arms by engaging said hook about the arm or projecting the arm through an opening produced by bending out said hook, access to said opening being gained by means of said slit.

7. The hanger sign as set forth in claim 6 wherein:

(a) said sign has a bending score extending thereacross dividing said sign into an upper and a lower face;

(b) said hook being cut primarily from said upper face.

* * * * *